US006131788A

United States Patent [19]

Marks

[11] Patent Number: 6,131,788

[45] Date of Patent: Oct. 17, 2000

[54] BUILT-IN EXTENDIBLE STAPLE GUN WIRE GUIDE

[75] Inventor: Joel S. Marks, Sherman Oaks, Calif.

[73] Assignee: WorkTools, Inc., Chatsworth, Calif.

[21] Appl. No.: 09/207,774

[22] Filed: Dec. 9, 1998

[51] Int. Cl.[7] ..... B25C 1/04

[52] U.S. Cl. ..... 227/132; 227/119; 227/140; 227/151; 227/156

[58] Field of Search ..... 227/132, 120, 227/140, 151, 119, 156

[56] References Cited

U.S. PATENT DOCUMENTS

| | | | |
|---|---|---|---|
| 2,137,642 | 11/1938 | Cavanagh | 227/132 |
| 2,668,290 | 2/1954 | Heller | 227/132 |
| 4,552,296 | 11/1985 | Sheng | 227/132 |
| 4,643,345 | 2/1987 | Knispel et al. | 227/156 |
| 4,693,407 | 9/1987 | Buck et al. | 227/131 |
| 4,801,061 | 1/1989 | Mangone, Jr. | 227/120 |
| 5,094,380 | 3/1992 | Nasiatka | 227/156 |
| 5,735,444 | 4/1998 | Wingert | 227/119 |
| 5,884,829 | 3/1999 | Wingert | 227/132 |
| 5,931,364 | 8/1999 | Dennis | 227/132 |

*Primary Examiner*—Peter Vo
*Assistant Examiner*—Jim Calve
*Attorney, Agent, or Firm*—Brad I Goldstein

[57] ABSTRACT

A device to improve attaching wires to a substrateby with a staple gun is disclosed. An elongated nose piece extends down from the front of the tool body and locks in position to hold the tool bottom a preset distance away from the substrate. The nose piece includes a recess to provide clearance for the wire as the nose piece is pressed against the substrate. The wire guide improves the operation of stapling wires by preventing the staple from crushing the wire and by aligning the tool over the wire so that the staple points are inserted a safe distance to each side of the wire. The present invention is an improvement over the prior art staple gun wire guides since it is a permanent part of the tool. It is slidably fixed to a vertical track at the front end of the tool. It does not increase the bulk of the tool front end and cannot be misplaced. In one embodiment the wire guide is internal to the tool in sliding contact with the plunger. In a further embodiment the wire guide is exposed along the front exterior of the tool.

11 Claims, 5 Drawing Sheets

BUILT-IN EXTENDIBLE STAPLE GUN WIRE GUIDE

FIELD OF THE INVENTION

The present invention relates to fastener driving tools. More precisely, the present invention relates to improvements in the operation of fastening wires by stapling.

BACKGROUND OF THE INVENTION

The present invention discloses an improved method to guide staples around wires. Staple guns are well known as a tool for fastening paper, cardboard, or similar thin materials to wood or other substrates. An additional application for staple guns is to hold electrical wires or similar items in place. The staple is installed over and around the wire. Typically staple guns are effective for only one or the other application. Wire staplers have a notched extension downward from the front end to position the staple over the wire. This feature however prevents the staple from seating flush when used for ordinary materials. A separate standard staple gun is required for that purpose.

U.S. Pat. No. 2,668,290 to Heller, shows a typical staple gun designed for tacking wires. Recess 102 is surrounded by extensions 64 (FIG. 8). The extensions prevent crushing a wire while also preventing flush seating of a staple. Extensions 64 are part of removable cover 24. It would be possible to exchange cover 24 for an equivalent additional component that had no notch and no extensions to enable flush stapling. However this would not be convenient.

U.S. Pat. No. 4,552,296 to Wang Sheng, shows a separate "adjustable wire attachment". This attachment can be moved downward to provide the required extension for guiding staples over wires. The attachment is around the front exterior of the tool and adds substantially to the bulk of the device. To make the device more reasonably compact it could be anticipated that a user who only occasionally tacks wires would remove the attachment and then not have it available when needed.

Other removable wire guide attachments are also well known in the retail market.

U.S. Pat. Nos. 2,137,642 and 3,265,278 show staple guns where a front cover can be pivoted outward to access the interior of the tool body.

A desirable improvement would be to have a wire guide feature which is permanently built into the structure of the staple gun but does not increase the external bulk of the tool nor substantially the cost. It is also desirable that the wire guide can be extended and retracted quickly.

Standard staples have a flat crown to hold materials down. Special wire staples have rounded crowns to better fit a rounded wire. The staples or the staple gun may be designed so that either type of staple can be used in the same tool. Such staple guns are readily available. Whether one or the other format staple is chosen, a wire guide provides the same utility.

SUMMARY OF THE INVENTION

In the present invention an extendible wire guide is slidably fitted at the front of a staple gun tool housing. A tab or similar operating device is linked to the wire guide to enable the wire guide to be deployed or retracted. A detent engages the tab or wire guide to hold the wire guide in position. In a preferred embodiment the wire guide is immediately adjacent to, and in sliding contact with, the plunger element.

Although the preferred embodiment wire guide is contained entirely within the tool body and latched by a detent action, variations are possible that retain the essential advantages of the present invention. In a one variation a wire guide may be exposed on the exterior of the tool body but well fitted so as to be an integral element of the device. The wire guide according to this variation would remain supported or enclosed by the tool body along a substantial portion of at least some edges or surfaces.

Within the possible variations, the focus of the present invention is an extendible wire guide fitted to a staple gun tacker in such a way that the wire guide elements are a permanent and not readily separable part of the staple gun. A detent or cam type latch secures the wire guide in position.

DETAILED DESCRIPTION OF THE ILLUSTRATED EMBODIMENT

Figure 2:
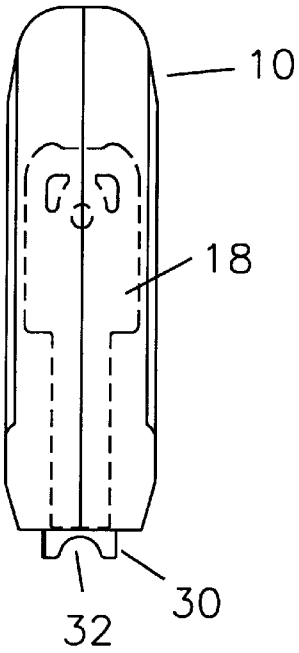
FIG. 2 is a front elevation of a staple gun body with the wire guide of FIG. 1 extended.
Figure 1:
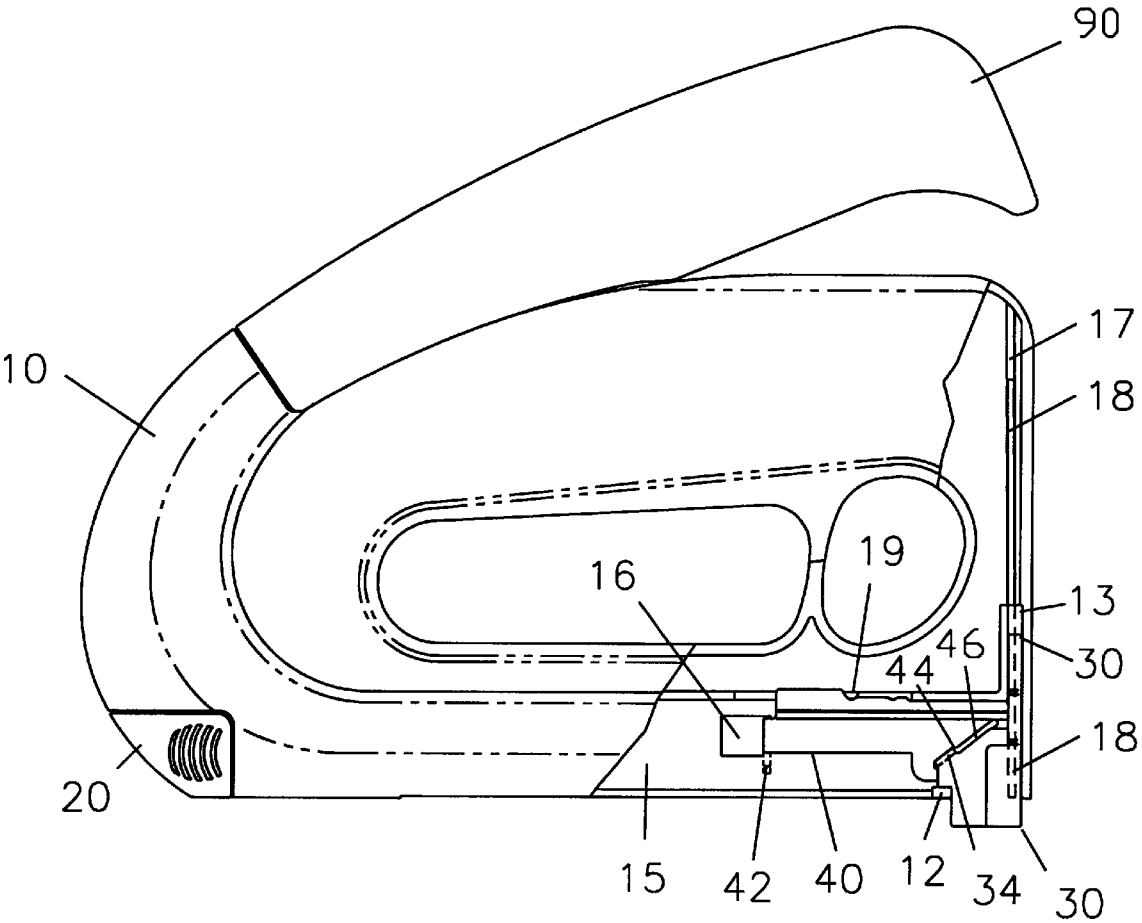
FIG. 1 is side elevation, partly in section, of a staple gun showing an extended wire guide.
Figure 3:
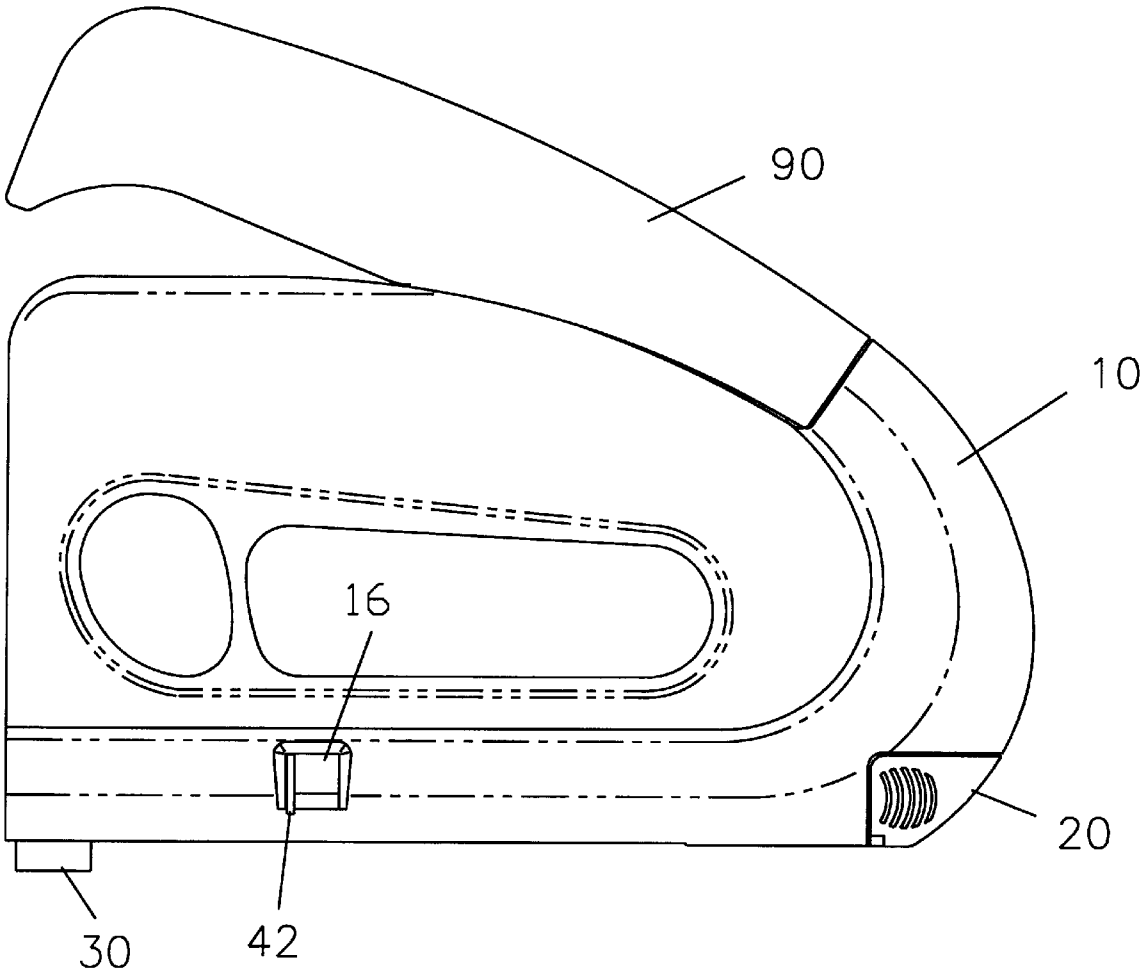
FIG. 3 is a side elevation of the staple gun of FIG. 1, with the tool rotated 180° to show the opposite side.
Figure 5:
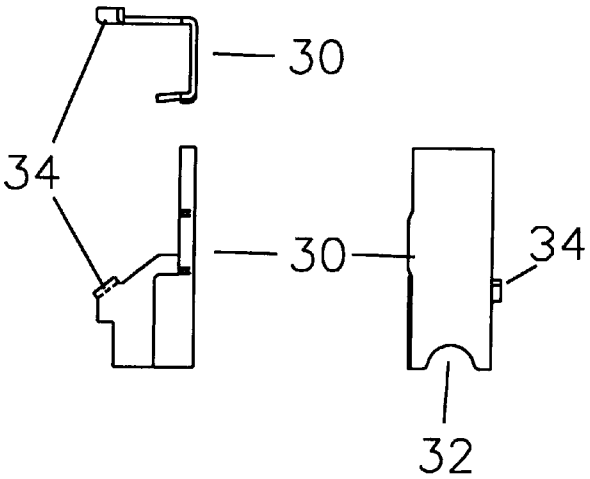
FIG. 5 is a side, a front and a top elevation of the wire guide of FIG. 1.
Figure 9:
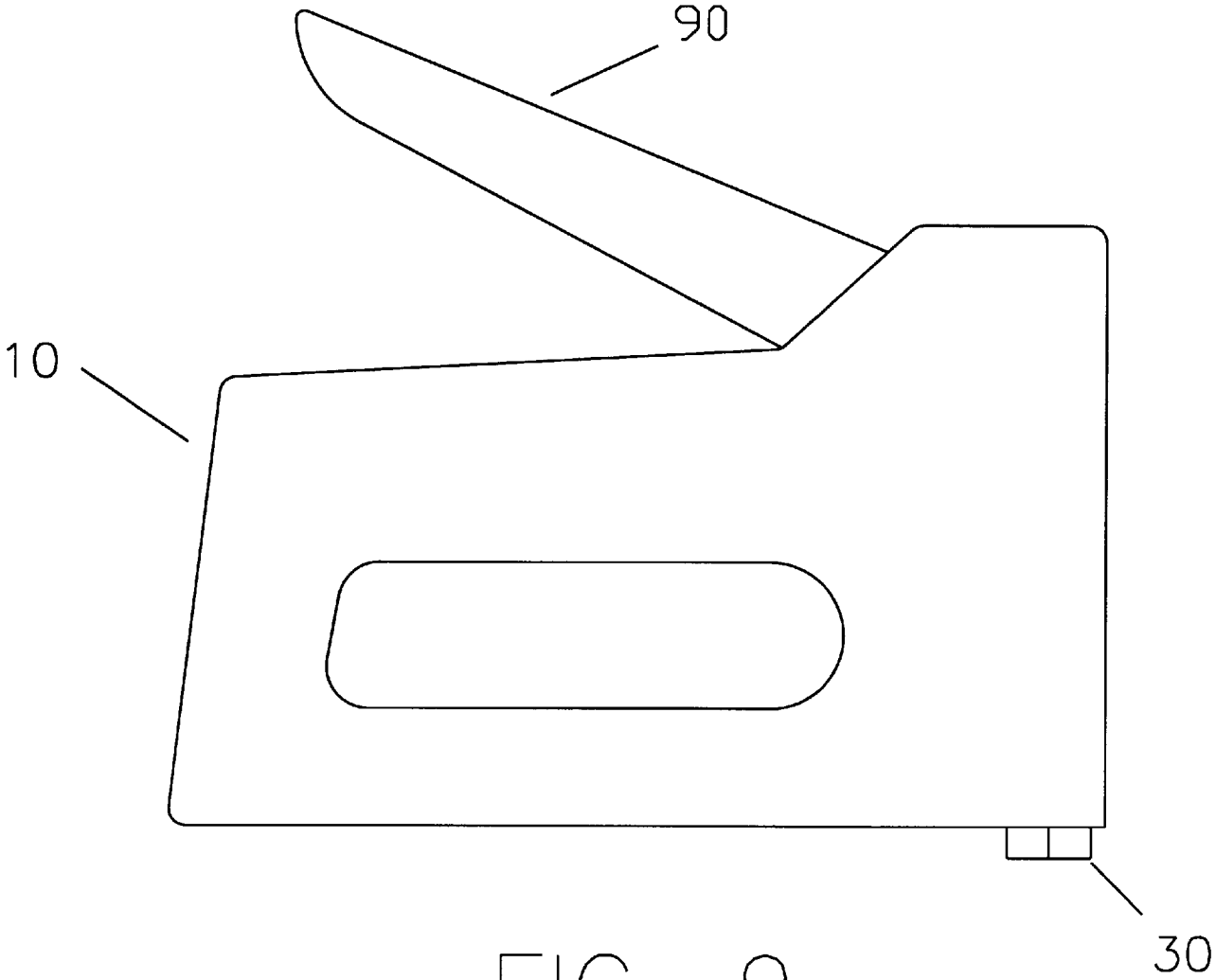
FIG. 9 is a side elevation of a rearward action staple gun with the wire guide of FIG. 1 extended.

FIGS. 1 and 3 show the invention as part of a forward action staple gun tool. FIG. 9 shows the invention in a rearward action staple gun. Other staple guns including pull-up handle style and electric tackers could be designed with the wire guide of the present invention.

FIG. 1 shows the exemplary elements of one embodiment of the invention. The embodiments of FIGS. 1 and 9 are especially suited for a tool where housing 10 is molded of a plastic material such as polycarbonate. Handle 90 is pivotably attached to housing 10. Track pull 20 operates a staple feeding guide track 18 to load fasteners into staple chamber 15. Staples are biased toward wire guide 30 at the front of chamber 15. A plunger, not shown, slides within guide slots 17.

Wire guide slot 13 and extension 12 of housing 10 help to slidably hold wire guide 30 within housing 10. In the illustrated embodiment of FIGS. 1 to 6 wire guide 30 has a sharp cornered "U" channel shape. A front most staple within chamber 15 presses the interior of wire guide 30. The plunger ejects this front staple downward out of the tool. The bottom portion of the plunger is guided by the three interior surfaces defined by the "U" shape of wire guide 30. In this embodiment the wire guide serves the additional functions of a conventional nose piece. In conventional designs a cover or front end piece is used to position the plunger and staples in the ejection area. It is one innovation of the present invention that an internal front end piece can also serve as an extendible wire guide.

Figure 6:
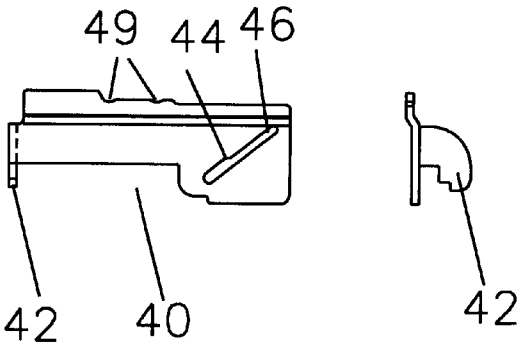
FIG. 6 is a side and a front elevation of a slide switch to extend and latch the wire guide of FIG. 5.
Figure 4:
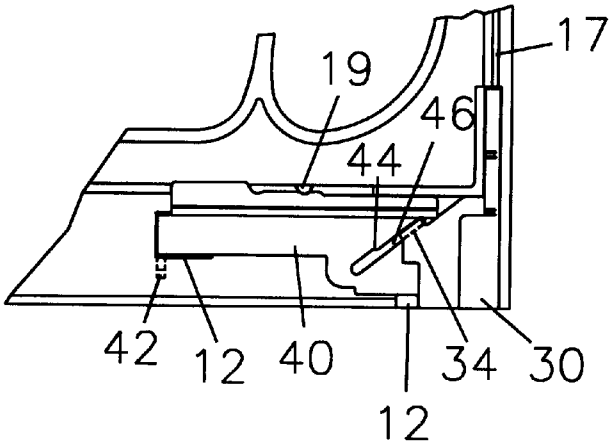
FIG. 4 is a detail view of a portion of a staple gun body with the wire guide of FIG. 1 in a retracted position.

Recess notch 32 provides clearance for wires. Tab 34 engages slide switch 40 at slot 46 so that sliding switch 40 front to back causes wire guide 30 to move up and down. The features of switch 40 are best seen in FIG. 6. Slot 46 includes a wide lower portion defined at notch 44. Notch 44 is a substantially horizontal edge of slot 46 to serve as a stop for tab 34 of wire guide 30. When switch 40 is in the forward position and wire guide 30 is extended, as in FIG. 1, notch 44 prevents upward force on wire guide 30 from forcing switch 40 backward. More than one notch 44 could be provided to allow multiple extended positions of the wire guide. Normal use of a staple gun involves pressing down on the front end of the tool even in a conventional rearward action type tool as in FIG. 9. It is therefore important that a wire guide of any design be able to resist this force. In case switch 40 slides loosely along chamber 15, detents 49 may be included. Detents 49 engage movable tab 19 where tab 19 may be an element of housing 10. Alternately switch 40 may slide with sufficient friction such that vibration and gravity will not unintentionally move switch 40. Tab 42 is exposed outside of chamber 15 through opening 16 (FIG. 3). A user moves tab 42 forward or backward to extend or retract wire guide 30. The function of tab 34 and slot 46 may be reversed so that wire guide 30 has a slot engaged with a tab of switch 40.

The embodiment described above is best for a plastic bodied tool since switch 40 absorbs the concentrated loads of tab 34. Wire guide 30 used alone would cause tab 34 to wear into a plastic material.

Figure 8:
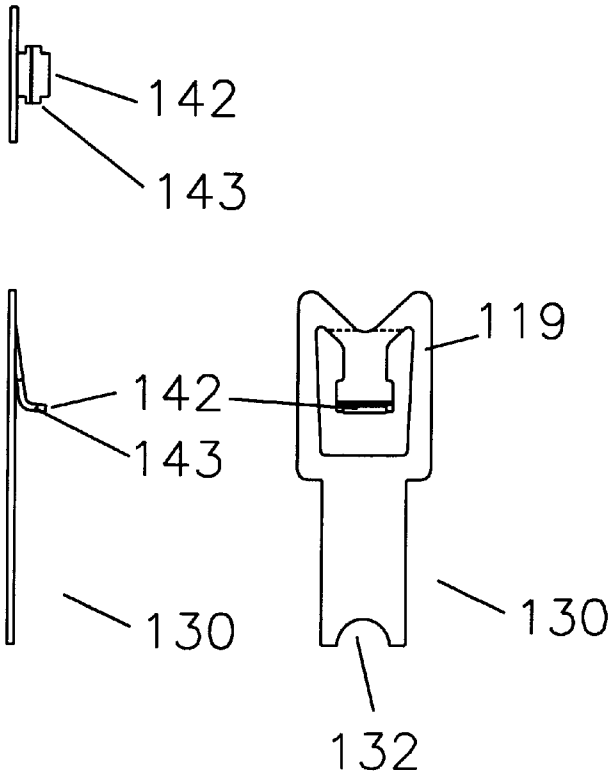
FIG. 8 is detailed views of the wire guide of FIG. 7 including side, front and top elevations.
Figure 7:
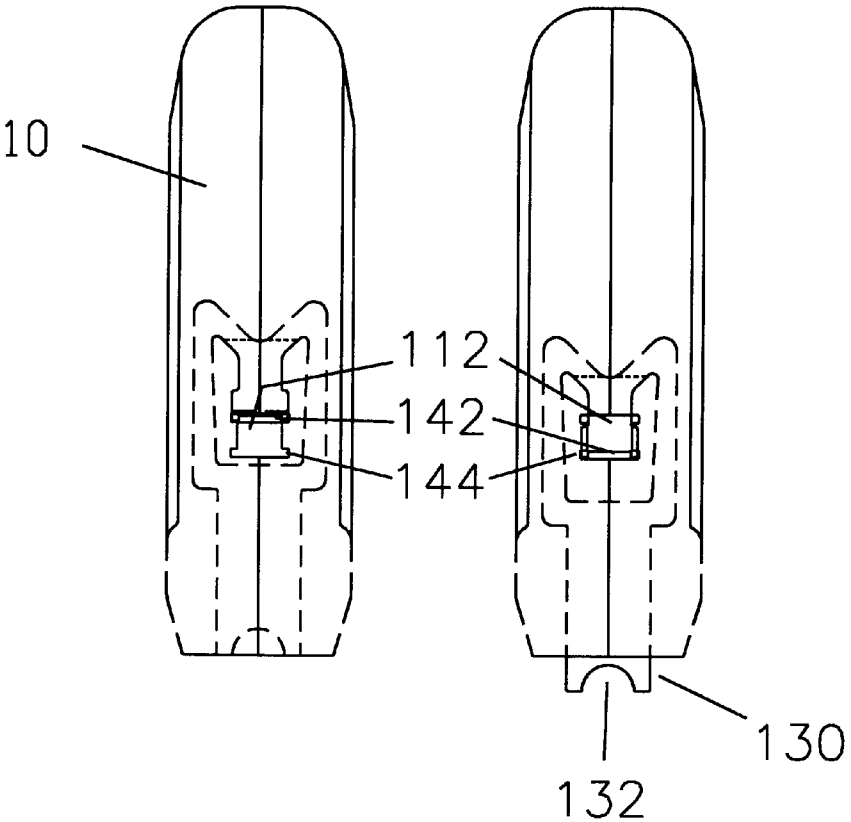
FIG. 7 is a front elevation of a staple gun housing showing an alternate embodiment wire guide, partly in phantom, with the wire guide in respective retracted and extended positions.

FIGS. 7 and 8 show an alternate embodiment wire guide. In contrast with the previous embodiment, wire guide 130 is a single component and locks against the housing directly. Wire guide 130 is best suited for use in a metal bodied tool, or where at least the front end of the tool is metal.

Tab 143 engages detent notches 144 of housing 10. Extension 142 is accessible to a finger to be pressed inward to disengage tab 143 from notch 144. Wire guide 130 can then be slid up and down to extend and retract wire guide 130. Arms 119 of wire guide 130 flex to allow inward motion of tab 143. A pair of notches 144 is at the top and bottom of opening 112 in housing 10 to lock wire guide 130 in either the up or down position. Additional notches may be included to provide more than two positions. However just at least one lower notch is required to lock wire guide 130 in the lower position since friction may hold it in the upper position. Recess 132 fits over a wire.

Preferably wire guide 130 is immediately in front of, and in sliding contact with, the plunger, not shown, so that the assembly including wire guide 130 is compact. Wire guide 130 then serves as the limiting front face of staple chamber 15 as described above for wire guide 30. In a further variation wire guide 130 could have a "U" shaped section similar in function to that of wire guide 30.

It is not necessary that the movable element of the detent action comprise flexible arms 119. For example a further movable or flexible element of the tool assembly may engage a detent feature of wire guide 130.

In a further embodiment wire guide 130 could be in a guide slot of housing 10 separate from the guide slot for the plunger. A different element than wire guide 130 would then be the front face of chamber 15.

The utility of the present invention is not limited to forward action staple guns. As shown in FIG. 9, the wire guide of the invention may be included as part of a conventional rearward action staple gun. An electric staple gun could also support the wire guide of the present invention.

A further alternate embodiment of the invention is a wire guide that is exposed at least partially to the exterior at the front of the tool body. It is not required according to the invention that the wire guide be fully confined within the housing. To function as a permanent component of the staple gun the wire guide is held securely and compactly at the front of the tool body in a slidable relationship with the tool body. Vertically extending slots or ribs fix the wire guide slidably to the housing. In the case of FIG. 1, slot 13 serves this function. In the case of FIG. 7, a slot and rib feature adjacent to or coincident with slot 17, seen in FIG. 1, positions the wire guide. According to the present alternate embodiment equivalent slots or ribs may be on the exterior of the housing body. The wire guide may then be elongated along the exterior front of the housing where the slots or ribs provide an elongated support to slidibly fix the wire guide to the housing.

To slide without wobble or binding the wire guide is elongated vertically. The wire guide further has a means to secure it in a selected vertical position. A detent latch is the most compact means for securing the wire guide. An eccentric wedging type cam could also secure the wire guide. In this design a pivoting lever or similar member is rotated about a fixed pivot so that a cam of the lever, directly or through a further member, progressively presses a surface of the wire guide to lock the wire guide in position. A screw or nut device also may secure the wire guide.

I claim:

1. A fastening tool to attach wires to a substrate with fasteners driven by impact blow comprising:

a housing body including a front, a rear, a top and a bottom;

a fastener guide track attached to the housing near the bottom thereof, to guide fasteners toward the front of the housing;

a plunger located at the front of the housing body, the plunger oriented to expel objects at a front of the fastener guide track out of the fastening device;

a wire guide slidably fitted within a slot at the front of the housing, the wire guide able to move vertically between an upper vertical position and a lower vertical position, the lower vertical position including a portion of the wire guide protruding downward out of the bottom of the housing body at the front of the housing body;

a switch slidably fitted within a chamber of the housing body, the switch able to move horizontally between a rear position and a front position, said switch being movable by an element of the switch accessible from outside of the housing body;

the switch linked to the wire guide wherein moving the switch horizontally causes the wire guide to move vertically;

a locking element to secure the wire guide in the lower vertical position.

2. The fastening device of claim 1, wherein a tab of the wire guide extends through an angled slot of the switch, and moving the switch causes an edge of the angled slot to slidably press the tab of the wire guide, whereby the wire guide moves downward.

3. The fastening device of claim 2, wherein an edge of the slot includes at least one horizontal segment, and the horizontal segment is immediately above the tab when the wire guide is in the lower vertical position, and when the wire guide is pressed upward the tab presses the horizontal segment.

4. The fastening device of claim 1, wherein the wire guide is immediately in front of the plunger and in sliding contact with the plunger.

5. The fastening device of claim 4, wherein the wire guide has a "U" shaped transverse cross section, and the wire guide partially surrounds the plunger.

6. The fastening device of claim 1, wherein the wire guide has a bottom edge, and the bottom edge has a recess notch.

7. A fastening tool to attach wires to a substrate with fasteners driven by impact blow comprising:

a housing body including a front, a rear, a top and a bottom;

a fastener guide track attached to the housing near the bottom thereof, to guide fasteners toward the front of the housing;

a plunger located at the front of the housing body, the plunger oriented to expel objects at a front of the fastener guide track out of the fastening device;

a wire guide slidably fitted within a slot at the front of the housing, the wire guide able to move vertically between an upper vertical position and a lower vertical position, the lower vertical position including a portion of the wire guide protruding downward out of the bottom of the housing body at the front of the housing body;

the wire guide including at least one wire guide detent element accessible from outside of the housing body and able to be engaged selectively with at least one housing detent element such that the wire guide is secured in the lower vertical position against an upward force applied to the wire guide.

8. The fastening device of claim 7, wherein the wire guide is elongated vertically and is oriented substantially in a parallel relationship with the plunger.

9. The fastening device of claim 8, wherein the wire guide is immediately in front of the plunger and in sliding contact with the plunger.

10. The fastening device of claim 9, wherein the wire guide has a "U" shaped transverse cross section, and the wire guide partially surrounds the plunger.

11. The fastening device of claim 7, wherein the wire guide has a bottom edge, and the bottom edge has a recess notch.

* * * * *